US011162163B2

(12) United States Patent
Park et al.

(10) Patent No.: US 11,162,163 B2
(45) Date of Patent: Nov. 2, 2021

(54) METHOD FOR PRODUCING COPPER-TITANIUM BASED COPPER ALLOY MATERIAL FOR AUTOMOBILE AND ELECTRONIC PARTS AND COPPER ALLOY MATERIAL PRODUCED THEREFROM

(71) Applicant: Poongsan Corporation, Pyeongtaek-Si (KR)

(72) Inventors: Cheol Min Park, Ulsan (KR); Jun Hyung Kim, Ulsan (KR); Hyo Moon Nam, Ulsan (KR); Tae Yang Kwon, Ulsan (KR)

(73) Assignee: Poongsan Corporation, Pyeongtaek-si (KR)

( * ) Notice: Subject to any disclaimer, the term of this patent is extended or adjusted under 35 U.S.C. 154(b) by 347 days.

(21) Appl. No.: 16/462,212

(22) PCT Filed: Sep. 21, 2018

(86) PCT No.: PCT/KR2018/011207
§ 371 (c)(1),
(2) Date: May 17, 2019

(87) PCT Pub. No.: WO2019/107721
PCT Pub. Date: Jun. 6, 2019

(65) Prior Publication Data

US 2020/0377986 A1 Dec. 3, 2020

(30) Foreign Application Priority Data

Nov. 28, 2017 (KR) ..... 10-2017-0160730

(51) Int. Cl.
*C22F 1/08* (2006.01)
*C21D 8/02* (2006.01)
(Continued)

(52) U.S. Cl.
CPC ..... *C22F 1/08* (2013.01); *C21D 8/0236* (2013.01); *C21D 8/06* (2013.01); *C21D 8/10* (2013.01); *C22C 9/00* (2013.01)

(58) Field of Classification Search
CPC ..... C22F 1/08; C21D 8/0236; C21D 8/06; C21D 8/10; C22C 9/00
See application file for complete search history.

(56) References Cited

U.S. PATENT DOCUMENTS

2012/0267013 A1* 10/2012 Kaneko ..... C22C 9/06 148/554

FOREIGN PATENT DOCUMENTS

JP 2001303222 A 10/2001
JP 2011026635 A 2/2011
(Continued)

OTHER PUBLICATIONS

Korean Intellectual Property Office, International Search Report, dated Jan. 3, 2019, 8 pages.

*Primary Examiner* — Christopher S Kessler
*Assistant Examiner* — Andrew M Cheung
(74) *Attorney, Agent, or Firm* — Loeb & Loeb LLP

(57) ABSTRACT

The present invention relates to a production method of a copper-titanium (Cu—Ti)-based copper alloy material and a copper alloy material produced therefrom. Thus, the copper alloy material has target yield strength, electrical conductivity, and bending workability and thus is applied to automobiles and electric/electronic parts requiring high performance.

8 Claims, 4 Drawing Sheets

| Point | Chemical Composition (wt%) | | |
|---|---|---|---|
| | Cu | Ti | Ni |
| 1 | 65.81 | 25.45 | 10.74 |
| 2 | 80.73 | 16.20 | 3.08 |
| 3 | 58.63 | 27.30 | 14.07 |
| 4 | 57.35 | 28.43 | 14.22 |
| 5 | 55.94 | 28.10 | 15.96 |
| 6 | 57.83 | 27.67 | 14.50 |
| 7 | 57.97 | 27.58 | 14.45 |

(51) Int. Cl.

| | |
|---|---|
| ***C21D 8/06*** | (2006.01) |
| ***C21D 8/10*** | (2006.01) |
| ***C22C 9/00*** | (2006.01) |

(56) References Cited

FOREIGN PATENT DOCUMENTS

| | | | | |
|---|---|---|---|---|
| JP | 2012087343 | A | * | 5/2012 |
| JP | 2014185370 | A | | 10/2014 |
| JP | 2015096642 | A | | 5/2015 |
| KR | 10-2012-0040114 | A | | 4/2012 |

* cited by examiner

| Point | Chemical Composition (wt%) | | |
|---|---|---|---|
| | Cu | Ti | Ni |
| 1 | 63.81 | 25.45 | 10.74 |
| 2 | 80.73 | 16.20 | 3.08 |
| 3 | 58.63 | 27.30 | 14.07 |
| 4 | 57.35 | 28.42 | 14.23 |
| 5 | 55.84 | 28.10 | 16.06 |
| 6 | 57.83 | 27.67 | 14.50 |
| 7 | 57.97 | 27.58 | 14.45 |

| Feature | Cu-3.2Ti-0.25Ni |
|---|---|
| Average grain size of precipitate (nm) | 119 ± 97 |
| Areal density of precipitate ($10^8/cm^2$) | 4.4 |

METHOD FOR PRODUCING COPPER-TITANIUM BASED COPPER ALLOY MATERIAL FOR AUTOMOBILE AND ELECTRONIC PARTS AND COPPER ALLOY MATERIAL PRODUCED THEREFROM

CROSS REFERENCE OF RELATED APPLICATIONS

The present application is a US national stage of a PCT international application, Serial no. PCT/KR2018/011207, filed on Sep. 21, 2018, which claims the priority of Korean patent application No. 10-2017-0160730, filed with KIPO of Republic of Korea on Nov. 28, 2017, the entire content of these applications are incorporated into the present application by reference herein.

TECHNICAL FIELD

The present disclosure relates to a method for producing a copper alloy material for an automobile part and an electric or electronic part having excellent yield strength, electrical conductivity and bending workability, and a copper alloy material produced from the method. More specifically, the present disclosure relates to a method for producing a copper-titanium (Cu—Ti)-based copper alloy material having excellent yield strength, electrical conductivity and bending workability, wherein the copper-titanium (Cu—Ti)-based copper alloy material may be used as an information transfer material and an electrical contact material such as a small and precision connector, spring material, semiconductor lead frame, automobile and electric and electronic connector, relay material, etc. and relates to the copper alloy material produced from the method.

BACKGROUND

Trends of automobile, electric and electronic, information communication, and semiconductor industries have need and demand for environmentally friendly materials, and have more complicated electric circuit configurations due to diversification of functions to be implemented in final products, and, at the same time, have a demand for realizing high performance, miniaturization, and high integration of parts thereof. Copper alloy materials used for various connectors, terminals, switches, relays, and lead frames as used in these industrial fields have employed a number of kinds of copper alloy materials as developed to meet requirements such as high strength.

Copper-beryllium (Cu—Be)-based copper alloys are used as copper alloys with high strength properties above 950 MPa. The copper-beryllium-based copper alloys have excellent strength and bendability and have excellent fatigue resistance and non-magnetic properties. Thus, the copper-beryllium based copper alloys are mainly used for the electric and electronic parts such as precision switches, terminals, and mobile phone parts. However, the beryllium (Be), which is an additive element, is contained in the dust generated during dissolution/casting and machining. Since the Be is harmful to the human body, use of the Be is expected to be restricted continuously in the future. A further disadvantage is that the production cost of the copper-beryllium (Cu—Be)-based copper alloys is very expensive. Therefore, the copper-beryllium (Cu—Be)-based copper alloy is rapidly replaced with a copper-titanium (Cu—Ti)-based copper alloy which has a strength comparable to that of the copper-beryllium (Cu—Be)-based copper alloy yet which does not contain the harmful component, beryllium (Be).

The copper-titanium (Cu—Ti)-based copper alloy is a spinodal decomposition type alloy. Thus, the strength thereof is improved by the spinodal decomposition of titanium (Ti). The titanium (Ti) in the copper (Cu) matrix forms an intermetallic compound with the copper. Then, the intermetallic compound precipitates into a second phase in grain boundaries or grains. However, since the titanium (Ti) is very active, Ti tends to be easily consumed when Ti reacts with other additive elements to form compounds. Thus, Ti is ineffective in suppressing grain boundary reaction-based precipitation using the segregation to the grain boundary. Further, when too many of the additive elements are added, the amount of solid titanium Ti may be consumed by the additive elements, thereby canceling an advantage of the copper-titanium (Cu—Ti)-based alloy.

The currently commercially available copper-titanium (Cu—Ti)-based copper alloy material is limited to a copper-titanium (Cu—Ti) or copper-titanium-iron (Cu—Ti—Fe) alloy material. In patent documents as already filed, many attempts have been made to attempt to simultaneously realize both of strength and bending workability. Some patent documents disclose that the simultaneously realization of both of the strength and bending workability can be obtained even when various other elements are added to the above-mentioned commercialized alloy. However, test results proving the disclosure are not presented or actual products having the effect have not been commercialized. In fact, when various elements are added to the above-mentioned commercialized alloy, the bending workability is deteriorated when the strength is increased, whereas as the bending workability increases, the strength decreases. Thus, it is very difficult to secure both high strength and excellent bending workability.

However, the latest trends in automotive, electrical and electronic, information communication, and semiconductor industries demand that the copper alloy materials have high strength characteristics that the materials can withstand a stress imparted during assembly and operation of a device, and have excellent bending workability capable of enduring severe bending deformation.

For example, recently, electric and electronic parts such as parts of mobile phones have diversified functions and are minimized and are complicated in shape. Thus, not only to improve the shape and dimensional accuracy of the workpiece, but also to enhance the maximum yield strength the part material can withstand are required. In other words, when the workpiece is bent, a force from the elastic deformation of the workpiece is applied to the copper alloy to obtain the contacting pressure at the electrical contact. When the stress generated inside the copper alloy bending the workpiece exceeds the yield strength of the copper alloy, the copper alloy sheet is subjected to plastic deformation and the contacting pressure (spring-like performance) is lowered and thus the workpiece is sagged. For this reason, the higher the yield strength of the copper sheet, the higher the contacting strength (spring-like performance), and thus the higher the yield strength is required. However, in general, the yield strength tends to have an inversely proportional relationship with the bending workability. Thus, there are many difficulties in realizing target properties of the copper alloy. Further, the copper alloy materials are widely used as excellent electrical conductors. However, the copper-titanium (Cu—Ti) alloy has an electrical conductivity of about 10 to 13% IACS and thus its electrical conductivity is much lower than that of the general copper alloy material. Therefore, it is not advantageous that the copper-titanium (Cu—Ti) alloy may not be employed as materials for electrical and electronic parts which simultaneously require the high strength and electric conductivity, such as the lead frames and electrical accessories for transistors and integrated circuits.

Referring to recent research trends, the copper-titanium (Cu—Ti)-based alloys have been studied to realize excellent bending workability in both the rolling direction and the direction perpendicular to the rolling direction while maintaining the high strength. Further, research has also been actively conducted to improve the electrical conductivity of the copper-titanium (Cu—Ti)-based alloys by controlling the precipitation amount of copper-titanium (Cu—Ti)-based intermetallic compound.

In Japanese Patent Application Publication No. 2004-091871, improvement of the production process is carried out to improve bending workability while maintaining tensile strength and elastic strength. For example, after solution treating, cold rolling and aging, then, further cold to rolling is performed to control the intermetallic compound so that a content of the copper-titanium-iron (Cu—Ti—Fe) intermetallic compound among the second phase intermetallic compounds is 50% or larger. Therefore, the high strength is achieved and bending workability is improved. However, in the production process in this patent document, after the aging, the final rolling proceeds. This is advantageous in terms of strength improvement but is disadvantageous in terms of bending workability.

Korean Patent Application Publication No. 10-2004-0048337 discloses a copper alloy in which bending workability and strength are improved via adding a third element. For example, adding a third element group to a copper-titanium (Cu—Ti)-based alloy is executed to optimize the addition amount of titanium (Ti) and to optimize the addition amount of the third element group, such that the number of the second phase particles in which the content of the third element group in the second phase particles is at least 10 times larger than the content of the third element group in the entire alloy is controlled to be at least 70% of a total number of the second phase particles. This approach realizes excellent bending workability and strength at the same time. However, the approach in this patent document is based on the optimization of the additive element. Thus, the controlling scheme of the amount of the additive element has a limitation in satisfying both the strength and the bending workability.

In Korean Patent Application Publication No. 10-2015-0055055, in order to improve the yield strength of the copper-titanium (Cu—Ti)-based alloy, the crystal orientation analysis is executed using EBSD (Electron Back Scatter Diffraction). This analysis reported that the yield strength is improved when KAM (Kerner Average Misorientation) value is 1.5 to 3.0. A main production method to satisfy this condition includes a first solution treating, an intermediate rolling, a final solution treating, a pre-aging, an aging, and a cold rolling in this order. However, this production process is disadvantageous in that the production cost is too high in the industrial aspect. Further, in terms of copper alloy material properties, the pre-aging and aging treatments may form a large number of second-phase precipitates. However, as the pre-aging is carried out for a long time at a low temperature, the size of the precipitate is coarsened, which is favorable in terms of the strength but is very disadvantageous in terms of the bending workability. Therefore, the above-mentioned method may be limited to a specific purpose of the copper alloy material. In this approach, a yield strength of 1100 MPa or larger may be obtained, but the bending workability as achieved does not satisfy the required property.

Korean Patent Application Publication No. 10-2012-0121408 discloses the relationship between the bending workability and strength and the grain size and shape and the state of the second phase particle ((Cu—Ti)-based compound) in the copper-titanium (Cu—Ti)-based alloy. Specifically, after the solution treating, the aging and cold rolling are sequentially carried out to improve the strength and reduce a proportion of the coarse second phase particles. Thus, the high strength and bending workability are obtained. However, according to the approach in this patent document, the (311) crystal plane is developed by the cold rolling in the state where the solute atoms become a fully solid solution state, such that the strength is improved but the sufficient bending workability is not achieved.

Korean Patent Application Publication No. 10-2012-0040114 proposes an aging at a high temperature to improve the electric conductivity, and at the same time, a slow cooling rate such that a formation of the grain boundary reaction phase is more than that of the stable phase, and thus the reduction of strength and bending workability due to the coarsening of the stable phase is suppressed. Thus, the copper alloy has the yield strength of 850 MPa or larger, and electrical conductivity of 18% IACS or greater. However, the electrical conductivity is high, but, actually, the coarsening of the intermetallic compound due to the relatively high temperature aging results in a yield strength of only 850 MPa. Thus, when the copper alloy material is treated, the stress generated inside the copper alloy exceeds the yield strength of the copper alloy and thus the plastic deformation occurs in the plate of the copper alloy and thus the contacting pressure (spring-like performance) drops and the workpiece sags. Thus, the strength of the copper alloy sheet is not sufficient.

Therefore, the copper alloy material as described in the above prior patent documents has a high strength. However, the bending workability is evaluated only using a simple 90° bend test, that is, a W bend test. Therefore, this may not prove that the improvement of bending workability is sufficient. Depending on the application of the copper alloy, when the strength is increased, the bending workability may not be satisfied. Further, the strength is reduced when the electrical conductivity is improved.

However, in recent years, connectors for electric/electronic parts including mobile phone components, lead frames for transistors and integrated circuits, and electrical accessories and the like have become smaller and more highly integrated. Thus, accordingly required properties may include a yield strength of 900 MPa or higher, an electrical conductivity of 15% IACS or higher, and a bending workability to 90° to 180°. As mentioned above, the beryllium copper (Cu—Be) alloy is widely used as the copper alloy material with excellent yield strength, electrical conductivity and bending workability. However, the toxicity of beryllium is problematic, and the complexity of the production process makes it costly. Thus, although the copper-titanium (Cu—Ti)-based alloy is used as a substitute thereof, the copper-titanium (Cu—Ti)-based alloy has a limitation in realizing properties comparable to the copper-beryllium (Cu—Be) based alloy. Copper-titanium (Cu—Ti)-based alloy material which meets the above requirements has not yet been successfully developed.

SUMMARY

The present disclosure provides a copper alloy material excellent in yield strength, electric conductivity and bending workability and used for automobiles and electric and electronic parts by improving the properties of the copper-titanium (Cu—Ti)-based copper alloy in a different approach, and provides a method for producing the copper alloy material.

In one aspect of the present disclosure, there is provided a method for producing a copper alloy material for automobile and electric and electronic parts, wherein the copper alloy material contains 1.5 to 4.3 wt % of titanium (Ti), 0.05 to 1.0 wt % of nickel (Ni), 0.8 wt % or smaller of incidental impurities, and the balance being copper (Cu), wherein the incidental impurities are at least one element selected from a group consisting of Sn, Co, Fe, Mn, Cr Zn, Si, Zr, V and P, and wherein a weight ratio of titanium/nickel (Ti/Ni) is in a range of 10<(Ti/Ni<18, wherein the method comprises: (a) dissolving and casting 1.5 to 4.3 wt % of titanium (Ti), 0.05 to 1.0 wt % of nickel (Ni), 0.8 wt % or smaller of incidental impurities, and the balance of copper (Cu) to obtain a slab; (b) hot-working the obtained slab at 750 to 1000° C. for 1 to 5 hours; (c) first cold working at a cold rolling reduction ratio or a cold working ratio of 50% or greater; (d) intermediate heat treating at 550 to 740° C. for 5 to 10000 seconds, (e) second cold working at a cold rolling reduction ratio or a cold working ratio of 50% or greater; (f) solution treating at 750 to 1000° C. for 1 to 300 seconds; (g) first aging at 550 to 700° C. for 60 to 1800 seconds, continuously lowering a temperature, and then second aging at 350 to 500° C. for 1 to 20 hours; (h) final cold working treating at a cold rolling reduction ratio or a cold working ratio of 5 to 70%; and (i) stress removal treating at 300 to 700° C. for 2 to 3000 seconds. In one embodiment, each of the steps (e) and (f) is optionally repeated two to five times. In one embodiment, the method further comprises correcting a shape of a plate after or before the (g) step. In one embodiment, the method further comprises plating tin (Sn), silver (Ag), or nickel (Ni) on a plate after the (i) step. In one embodiment, the method further comprises forming the obtained product into a plate, rod, or tube form.

In one embodiment, fine precipitates at a size in a range of 300 nm or smaller are uniformly distributed in a copper matrix of the copper alloy material, wherein each of the fine precipitates includes at least one selected from a group consisting of (Cu,Ni)Ti, $(Cu,Ni_3)Ti_2$, $(Cu,Ni)_3Ti$, and $(Cu,Ni)_4Ti$. In one embodiment, an areal density of the fine precipitates is greater than or equal to $2.5\times10^8/cm^2$. In one embodiment, the copper alloy material has a yield strength of at least 900 MPa, an electrical conductivity of at least 15% IACS, and a bending workability R/t≤1.5 (180°) in both a rolling direction and a direction perpendicular to the rolling direction at a 180° bending test, wherein R indicates a bending radius of curvature and t indicates a thickness of the material.

The present disclosure provides the copper alloy material for automotive and electrical components having excellent yield strength, electrical conductivity and bending workability and provides the method for producing the copper alloy material.

SUMMARY

Figure 1A:
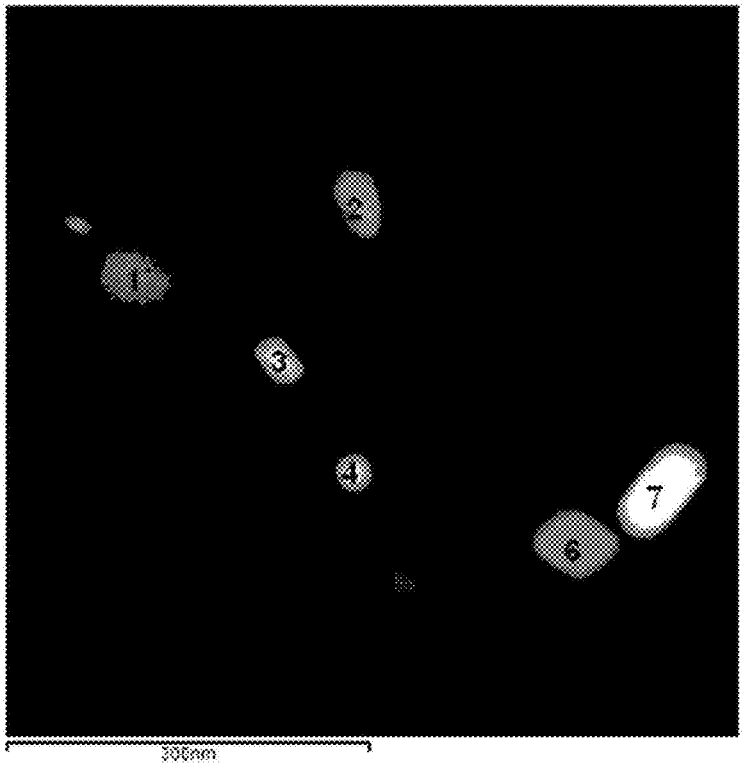
FIG. 1A shows a photograph using replica analysis of a field emission transmission electron microscope (FE-TEM) and a point EDS analysis result of a plate material sample made of a copper alloy material according to the present disclosure produced based on a composition (Cu-3.2Ti-0.25Ni) disclosed in a No. 1 of Table 1.
Figure 1B:
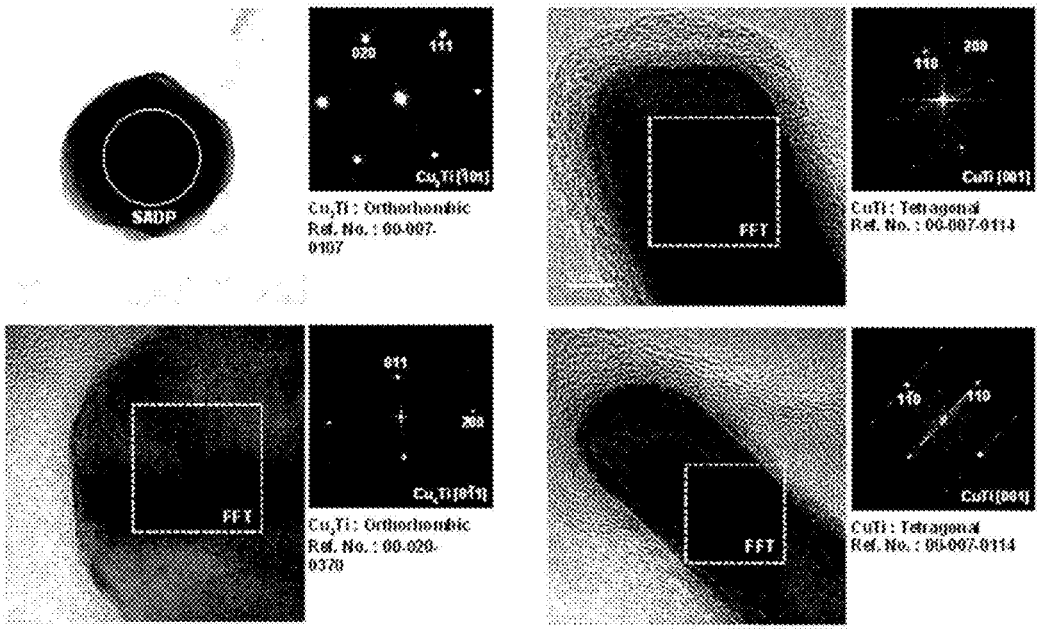
FIG. 1B shows photographs of images of fine precipitates of (Cu,Ni)Ti, $(Cu,Ni_3)Ti_2$, $(Cu,Ni)_3Ti$, and $(Cu,Ni)_4Ti$, as replica analysis results of a field emission transmission electron microscope (FE-TEM) of a plate material sample made of a copper alloy material according to the present disclosure produced based on a composition (Cu-3.2Ti-0.25Ni) disclosed in a No. 1 of Table 1.

The present disclosure provides a method for producing copper alloy material with improved strength properties including yield strength, improved electrical conductivity and improved bending workability, and provides copper alloy material produced therefrom.

Followings describe a method for producing the copper alloy material according to the present disclosure.

Method for Producing Copper Alloy Material According to the Present Disclosure

The conventional copper-titanium (Cu—Ti)-based copper alloy material is generally produced by dissolving/casting, hot rolling, (repetition of heat treating and cold rolling), solution treating, cold rolling and aging in this order.

On the other hand, the method for producing he copper alloy material according to the present disclosure may produce a copper alloy material for automobile and electric and electronic parts, wherein the copper alloy material contains: 1.5 to 4.3 wt % of titanium (Ti); 0.05 to 1.0 wt % of nickel (Ni); 0.8 wt % or smaller of incidental impurities, wherein the incidental impurities are at least one element selected from a group consisting of Sn, Co, Fe, Mn, Cr, Zn, Si, Zr, V and P; and the balance being copper (Cu), wherein a weight ratio of titanium/nickel (Ti/Ni) is in a range of 10<Ti/Ni<18. In accordance with the present disclosure, the copper alloy materials with improved strength properties including yield strength, improved electrical conductivity and improved bending workability may be produced as follows.

The method for producing the copper alloy material according to the present disclosure may include (a) dissolving and casting 1.5 to 4.3 wt % of titanium (Ti), 0.05 to 1.0 wt % of nickel (Ni), 0.8 wt % or smaller of incidental impurities, and the balance of copper (Cu) to obtain a slab; (b) hot-working the obtained slab at 750 to 1000° C. for 1 to 5 hours; (c) first cold-working at a cold rolling reduction ratio or a cold working ratio of 50% or greater; (d) intermediate heat treating at 550 to 740° C. for 5 to 10000 seconds; (e) second cold-working at a cold rolling reduction ratio or a cold working ratio of 50% or greater; (f) solution treating at 750 to 1000° C. for 1 to 300 seconds; (g) first aging at 550 to 700° C. for 60 to 1800 seconds, continuously lowering a temperature, and then second aging at 350 to 500° C. for 1 to 20 hours; h) final cold-working at a cold rolling reduction ratio or a cold working ratio of 5 to 70% and (i) stress removal treating 300 to 700° C. for 2 to 3000 seconds.

Specific production conditions for the copper alloy material according to the present disclosure are as follows.

(a) Dissolving and Casting

A composition of the copper alloy material according to the present disclosure may be controlled to contain 1.5 to 4.3 wt % of titanium (Ti), 0.05 to 1.0 wt % of nickel (Ni), 0.8 wt % or smaller of incidental impurities, and the balance of copper (Cu). Thus, the method includes dissolving and casting titanium (Ti), nickel (Ni), and the balance of copper (Cu) to obtain a slab. In order to prevent the oxidation of titanium (Ti), dissolution is carried out using a vacuum dissolving furnace and the casting is performed in an inert gas atmosphere to obtain the slab. In this connection, the weight ratio of titanium/nickel (Ti/Ni) is in the range of $10<Ti/Ni<18$. The above-mentioned inevitable impurities may be included in the above process, but the total amount of the incidental impurities should be controlled so as not to exceed 0.8 weight %.

(b) Hot-Working

The hot-working may be carried out at a temperature of 750 to 1000° C. for 1 to 5 hours, preferably 850 to 950° C. for 2 to 4 hours. When the hot-working is carried out at 750° C. or lower for 1 hour or smaller, the casted structure remains, and thus the probability of occurrence of defects such as cracks during the hot-working is high and the strength and bending workability in the finished product production are inferior. Further, when the temperature is higher than 1000° C. or the working timing is longer than 5 hours, the crystal grains become coarser and the bending workability in the production is lowered due to the final product thickness.

(c) First Cold-Working

The first cold-working after the hot-working is carried out at a room temperature. A first cold-rolling reduction ratio or cold-working ratio is greater than or equal to 50%. When the first cold-working ratio is lower than 50%, sufficient precipitation driving force does not occur in the copper (Cu) matrix, so recrystallization occurs late in a solution treating proceeding continuously in a short time, which is disadvantageous for the solution treating.

(d) Intermediate Heat Treating

The intermediate heat treating is carried out at 550 to 740° C. for 5 to 10000 seconds. In the intermediate heat treating process, copper, nickel-titanium ((Cu, Ni)—Ti)) precipitates having a size of 0.3 to 3 μm may be partially formed. Thereafter, when at a second cold-rolling reduction ratio or cold-working ratio of 50% or greater, a second cold-working is carried out, and, then, a solution treating is carried out, the copper, nickel-titanium ((Cu, Ni)—Ti)) precipitates as produced during the intermediate heat treating again become a solid solution state. Then, in the solution treating, aging and final cold-working, more copper, nickel-titanium ((Cu, Ni)—Ti)) fine precipitates may be produced to achieve high strength and bending workability simultaneously.

(e) Second Cold-Working

The second heat-treating may be followed by the second cold-working. In the second cold-working, the second cold-rolling reduction ratio or cold-working ratio is greater than or equal to 50%. The higher the cold-rolling reduction ratio or cold-working ratio is before the solution treating, more finely and uniformly, the copper, nickel-titanium ((Cu, Ni)—Ti)) precipitates may be distributed in the solution treating. Thus, it is advantageous to carry out the second cold-working at a cold-rolling reduction ratio or cold-working ratio of 50% or greater.

(f) Solution Treating

The solution treating is an important process to obtain the high strength and excellent bending workability. The solution treating may be carried out at 750 to 1000° C. for 1 to 300 seconds, preferably at 800 to 900° C. for 10 to 60 seconds. When the solution treating temperature is lower than 750° C. or the treating duration is smaller than 1 second, the solution treating does not form a sufficient supersaturated state. Thus, after the aging treatment, the copper, nickel-titanium ((Cu, Ni)—Ti)) precipitates may not be sufficiently produced. Thus, the tensile strength and yield strength may be lowered. When the solution treating is carried out at a temperature over 1000° C. or for a time duration over 300 seconds, the grain size grows to 50 μm or larger and thus the bending workability decreases. In particular, the bending workability in the rolling direction drops sharply.

(g) Double Aging Treatment

Aging treatment is an important step to improve the properties such as strength, electrical conductivity and bending workability via formation of fine precipitates. In the conventional aging-curing type copper alloy material production method, it is common to execute a single aging treatment. Some of the above-mentioned prior patent documents have introduced a pre-aging process. Specifically, in Korean Patent Application Publication No. 10-2015-0055055, the pre-aging process is performed at a low temperature of 150 to 250° C. for a long period of time of 10 hours or larger. Then, an aging is executed to uniformly precipitate the second phase particles. However, there occurs a disadvantage due to the long duration of the pre-aging in that the production process cost increases and the precipitate size increases, so that the bending workability is poor.

On the other hand, in the method for producing a copper alloy material according to the present disclosure, nickel (Ni) is added to the copper-titanium (Cu—Ti) based on the Ti/Ni ratio to produce precipitates of copper, nickel-titanium ((Cu, Ni)—Ti)). Then, introducing continuous double aging treatment after the solution treatment may allow distribution of finer precipitates to be obtained than that in the conventional one-stage aging treatment production process. That is, after the first aging at 550 to 700° C. for 60 to 1800 seconds, the temperature is continuously lowered and the second aging is performed at 350 to 500° C. for 1 to 20 hours. Thus, the precipitates produced in the first aging act as heterogeneous nucleation sites for precipitation in the second aging. Thus, finer precipitates may be uniformly distributed in the copper (Cu) matrix in the double aging treatments than in the single aging treatment. The first aging of the double aging treatments according to the present disclosure is carried out at 550 to 700° C. for 60 to 1800 seconds, and, subsequently, the temperature is lowered continuously and the second aging is performed at 350 to 500° C. for 1 to 20 hours.

It is important that the first aging is performed at 550 to 700° C. for 60 to 1800 seconds, that is, at a higher temperature in a shorter time than in the second aging. This first aging is an important process for securing the strength by forming some of $Cu_3Ti$ precipitates which is poor in coherency among the precipitates of copper, nickel-titanium ((Cu, Ni)—Ti) which are brought into the solid solution state after the solution treating. Then, the temperature is continuously lowered and the second aging is performed at 350 to 500° C. for 1 to 20 hours. Due to this second aging, in the final cold-working after the aging, the generation and growth of copper, nickel-titanium ((Cu, Ni)—Ti))-based fine precipitates in the grain boundaries and the copper (Cu) matrix occurs, and $Cu_3Ti$ precipitates with poor coherency are significantly changed to $Cu_4Ti$ precipitates with good coherency, and fine precipitates are uniformly distributed in the copper (Cu) matrix to improve strength and improve bending workability. When the temperature is lower than 350° C. and the aging time is shorter than 1 hour in the second aging, copper, nickel-titanium ((Cu, Ni)—Ti)) precipitates may not be sufficiently created and grown in the copper (Cu) matrix due to insufficient calorific value. Thus, the yield strength and bending workability may be deteriorated. When the temperature rises above 500° C. and the aging timing is over 20 hours in the second aging, an overaged region occurs, such that the bending workability has a maximum value, but the yield strength decreases.

(h) Final Cold-Working

A final cold-working is executed after the double aging treatments. The cold-rolling reduction ratio or cold-working ratio at the final cold-working is in a range of 5 to 70%. When the cold-rolling reduction ratio or the cold-working ratio is smaller than 5%, the tensile strength is significantly lowered. When the cold-rolling reduction ratio or the cold-working ratio at the final cold-working exceeds 70%, the bending workability is greatly reduced.

(i) Stress Removal Treating

The stress removal treating is carried out at 300 to 700° C. for 2 to 3000 seconds, preferably at 500 to 600° C. for 10 to 300 seconds. The stress removal treating step acts to remove the stress generated by the plastic deformation of the obtained product by applying heat thereto. Especially, this treating plays an important role in restoring an elastic strength after plate-shape correction. When the stress removal treating is carried out at a temperature lower than 300° C. or shorter than 2 seconds, this cannot sufficiently compensate for the elastic strength loss due to the plate-shape correction. When the temperature exceeds 700° C. or the duration exceeds 3000 seconds in this stress removal treating, softening occurs beyond the maximum recovery period of the elastic strength. Thus, the mechanical properties such as tensile strength and elastic strength may be lowered.

Among the above production method steps, each of (e) the second cold-working step and (f) the solution treating step may be repeatedly performed twice to five times as necessary. That is, the times of the repetition of each of (e) the second cold-working step and (f) the solution treating step may be based on a target thickness of the final product due to a thickness reduction of the copper alloy material due to miniaturization and high integration of automobile and electric and electronic parts.

Further, the plate-shape correction may be performed according to a target shape of the material before and after the aging. Those skilled in the art may appropriately perform the plate-shape correction step as needed.

Further, tin (Sn), silver (Ag), or nickel (Ni) plating may be performed on the plate after the stress removal step if necessary. Those skilled in the art may appropriately carry out the plating step as necessary.

In one example, the method may further include a step of forming the slab into a target form of a plate, rod, or tube, depending on the application of the copper alloy material. Specifically, the slab may be formed into a plate of a thickness of 0.03 to 0.8 mm. Alternatively, the slab may be formed into a rod or tube of 0.5 to 200Φ (=mm) of an outer diameter.

The present copper alloy material may be obtained using the method for producing the copper alloy material according to the present disclosure as described above.

The present copper alloy material as obtained using the method for producing the copper alloy material according to the present disclosure as described above may contain 1.5 to 4.3 wt % of titanium (Ti); 0.05 to 1.0 wt % of nickel (Ni); 0.8 wt % or smaller of incidental impurities, and the balance being copper (Cu), wherein the incidental impurities are at least one element selected from a group consisting of Sn, Co, Fe, Mn, Cr, Zn, Si, Zr, V and P wherein a weight ratio of titanium/nickel (Ti/Ni) is in a range of $10<Ti/Ni<18$, wherein fine precipitates at a size in a range of 300 nm or smaller are uniformly distributed in a copper matrix of the copper alloy material, wherein each of the fine precipitates includes at least one selected from a group consisting of $(Cu,Ni)Ti$, $(Cu,Ni_3)Ti_2$, $(Cu,Ni)_3Ti$, and $(Cu,Ni)_4Ti$, wherein an areal density of the fine precipitates is greater than or equal to $2.5\times10^8/cm^2$. The copper alloy material has a yield strength of at least 900 MPa, an electrical conductivity of at least 15% IACS, and a bending workability $R/t\leq1.5$ in both a rolling direction and a direction perpendicular to the rolling direction at a 180° bending test, wherein R indicates a bending radius of curvature and t indicates a thickness of the material.

Followings describe the constituent elements of the copper alloy material according to the present disclosure and reasons for their content limitations.

(1) Titanium (Ti)

Titanium (Ti) is an element contributing to the strength improvement via forming of precipitates with nickel (Ni). The content of titanium (Ti) in the copper alloy material according to the present disclosure is in the range of 1.5 to 4.3 wt %. When the titanium (Ti) content is lower than 1.5 wt %, a sufficient strength is not secured in the aging. A resulting alloy material is not suitable to be applied to automobile, electric and electronic connectors, semiconductors and lead frames. When the titanium (Ti) content exceeds 4.3 wt %, this causes side cracks in the hot-working due to crystals formed during the casting, which causes the bending workability to deteriorate.

(2) Nickel (Ni)

Nickel (Ni) is an element contributing to strength improvement via forming of precipitates with titanium (Ti). As the precipitates are finely and uniformly distributed, the strength can be improved and the bending workability can be improved at the same time. Thus, according to the present disclosure, the content of nickel (Ni) as added ranges from 0.05 to 1.0 wt %. The addition of nickel (Ni) to the copper-titanium (Cu—Ti)-based copper alloy may suppress the coarsening of precipitates during the solution treating. Thus, the solution treating may be realized at a higher temperature and titanium (Ti) may be sufficiently brough into a solid solution state. When the nickel content is lower than 0.05 weight %, this content is insufficient to obtain the above effect. However, when nickel (Ni) is added in excess of 1.0 weight %, the nickel-titanium (Ni—Ti) precipitates as produced increase the amount of titanium (Ti) as consumed, which lower the strength and bending workability.

(3) Weight Ratio of Titanium/Nickel (Ti/Ni)

In the copper alloy material according to the present disclosure, titanium and nickel are responsible forming the copper, nickel-titanium ((Cu, Ni)—Ti)) precipitates in the copper (Cu) matrix contributing to the strength and bending workability. In this connection, the weight ratio of titanium/nickel (Ti/Ni) contained in the copper alloy material is in a range of $10<Ti/Ni<18$. When the weight ratio of titanium/ nickel (Ti/Ni) is smaller than 10.0, the amount of titanium (Ti) as consumed by the formation of the copper, nickel-titanium ((Cu, Ni)—Ti)) precipitates increase, thereby to lower the strength and bending workability. When the weight ratio of titanium/nickel (Ti/Ni) is over 18.0, the strength effect due to the addition of nickel (Ni) may not be achieved. Therefore, the weight ratio of titanium/nickel (Ti/Ni) in the alloy composition of the copper alloy material according to the present disclosure is in range of $10<Ti/Ni<18$.

(4) Impurities (Sn, Co, Fe, Mn, Cr, Zn, Si, Zr, V, P)

The copper alloy material according to the present disclosure may optionally include one or more elements from the group consisting of Sn, Co, Fe, Mn, Cr, Zn, Si, Zr, V, and P as impurities. Although the impurities are not intentionally added, they are naturally added through the copper alloy material production process such as the dissolution and casting process. In the aging process, precipitates made of the copper, nickel-titanium ((Cu, Ni)—Ti)) and the impurities may occur in the matrix to increase the strength. The total amount of the impurities is not greater than 0.8 weight %. When the total amount of the impurities exceeds 0.8 weight %, titanium-nickel-X (Ti—Ni—X)-based (where X means the impurities) precipitates are produced at a large amount, resulting in a drastic decrease in the strength and bending workability.

The copper alloy material for automobiles and electronic parts as obtained according to the method for producing the copper alloy material in accordance with the present disclosure forms unique fine precipitates in the copper (Cu) matrix. In general, a copper-titanium (Cu—Ti)-based copper alloy has a $Cu_3Ti$ phase with a poor coherence with an a phase as a copper (Cu) matrix phase and a $Cu_4Ti$ phase with good coherency with the $\alpha$ phase. These fine particles with the $Cu_3Ti$ phase and $Cu_4Ti$ phase are known to contribute to strength properties. However, $Cu_3Ti$, which has the poor coherency with respect to the $\alpha$ phase is advantageous in terms of strength but adversely affects the bending workability. Recently, it has been reported that the $Cu_4Ti$ phase particles with the good coherency with respect to the $\alpha$ phase are finely and uniformly dispersed to achieve both strength and bending workability. Further, a technique has been reported for locally precipitating the $Cu_3Ti$ phase in the copper (Cu) matrix to achieve both strength and bending workability. However, even when the precipitation is localized, and when the $Cu_3Ti$ phase, which has the poor coherency in the copper (Cu) matrix is dispersed in a non-solid solution state in the grain boundary, the $Cu_3Ti$ as locally dispersed has adverse effect on the strength and bending workability in machining the slab.

On the other hand, the method for producing the copper alloy material in accordance with the present disclosure improves the properties of the copper-titanium (Cu—Ti)-based copper alloy material in a different manner from the above prior schemes, thereby to improve the yield strength, electrical conductivity and bending workability.

Specifically, the copper alloy material in accordance with the present disclosure is prepared by adding nickel (Ni) to the copper-titanium (Cu—Ti) based on the Ti/Ni ratio to precipitate copper, nickel-titanium ((Cu, Ni)—Ti)) and by performing the solution treating and then the double aging treatments such that complex precipitates including not only the $Cu_3Ti$ phase with the poor coherence and the $Cu_4Ti$ phase with the good coherency against the a phase as a copper (Cu) matrix phase but also a CuTi phase, $Cu_3Ti_2$ phase, etc. are distributed very finely and uniformly, thereby to ensure excellent yield strength and electrical conductivity as well as excellent bending workability.

The copper alloy material as obtained according to the method for producing the copper alloy material according to the present disclosure had a grain size of smaller than or equal to 5 μm in observing the cross-section of the material, and fine precipitates at a size in a range of 300 nm or smaller are uniformly distributed in a copper matrix of the copper alloy material, and an areal density of the fine precipitates is greater than or equal to $2.5\times10^8/cm^2$. In general, the average grain size of the copper alloy material greatly affects the strength and bending workability of the copper alloy material. The cross-section parallel to the rolling direction of the copper alloy material according to the present disclosure has an average grain size of 5 μm or smaller. When the average grain size on the cross-section parallel to the rolling direction is larger than 5 this is disadvantageous in terms of bending workability because this size value becomes a starting point of cracking in bending. Further, in the copper alloy material according to the present disclosure, fine precipitates at a size in a range of 300 nm or smaller are uniformly distributed in a copper matrix of the copper alloy material, and an areal density of the fine precipitates is greater than or equal to $2.5\times10^8/cm^2$. Thus, the copper alloy material has a yield strength of at least 900 MPa, an electrical conductivity of at least 15% IACS, and a bending workability $R/t\leq1.5$ in both a rolling direction and a direction perpendicular to the rolling direction at a 180° bending test, wherein R indicates a bending radius of curvature and t indicates a thickness of the material. In other words, when an areal density of the fine precipitates is lower than $2.5\times10^8/cm^2$, the yield strength of at least 900 MPa, and the electrical conductivity of at least 15% IACS may not be achieved. Further, even when an areal density of the fine precipitates is greater than or equal to $2.5\times10^8/cm^2$ but when the size of the precipitates is larger than 300 nm, the material surface is easily roughened or crack occurs during the bending, which is very disadvantageous in terms of the bending workability.

The yield strength of the copper alloy material as produced according to the present disclosure is at least 900 MPa, and more preferably at least 950 MPa. When the yield strength is lower than 900 MPa, the stress generated in the copper alloy during the working of the material exceeds the yield strength of the copper alloy, such that the contact-pressure (spring-like performance) is lowered due to the plastic deformation of the copper alloy sheet and thus the sheet sags. Thus, the higher the yield strength of the copper sheet is, the higher the contacting strength (spring-like performance) is achieved. Thus, the higher yield strength of the copper sheet is required.

The electrical conductivity of the copper alloy material as produced according to the present disclosure is greater than or equal to 15% IACS. Since the electrical conductivity of a conventional copper-titanium (Cu—Ti)-based copper alloy is 10 to 13% IACS, this value is insufficient to be used for information transfer and electrical contact materials. In other words, the material with at least 15% IACS may be used as the electrical contact material. In the copper alloy material according to the present disclosure, the amount of fine precipitates of 300 nm or smaller is maximally increased and the fine precipitates are uniformly distributed, thereby to obtain the electrical conductivity of 15% IACS or higher while maintaining the yield strength.

In the copper alloy material according to the present disclosure, the bending workability has $R/t\leq1.5$ (180°) in both the rolling direction and the direction perpendicular to the rolling direction, preferably, R/t≤1.0 (180°) in both the rolling direction and the direction perpendicular to the rolling direction. When the bending workability R/t (180°) exceeds 1.5 (where R indicates a bending radius of curvature and t indicates a thickness of the material), bending induced cracks occur in the bending of narrow workpieces, making it difficult to apply the copper alloy material to small-sized or complicated workpieces. Thus, preferably, the bending workability has R/t≤1.5 (180°).

Therefore, the yield strength, electrical conductivity and bending workability of the copper alloy material as produced by the production method of the present disclosure may be satisfied simultaneously to be applied to the target product.

EXAMPLE

Examples 1 to 10

The copper alloy material in accordance with the present example disclosure as described above was produced with the composition as disclosed in Table 1 under the process conditions as described in Table 2 below. Specifically, the constituent elements were combined based on the composition as described in Table 1, followed by dissolution and casting using a vacuum dissolution/casting machine. Thus, a copper alloy slab with a total weight of 2 kg and a thickness of 25 mm, a width of 100 mm and a length of 150 mm was produced. The copper alloy slab was hot-worked at 950° C. to 11 mm and was water-cooled to produce a plate. Then, both surfaces of the plate were ground by a 0.5 mm thickness to remove the oxide scale. After a first cold-working was performed such that the plate had a thickness of 5 mm, and an intermediate heat treating was performed under the temperature and hour conditions as described in Table 2. Thereafter, a second cold-working was carried out to a thickness of 0.4 mm at a reduction ratio of 92%. Then, as shown in Table 2, the solution treating, double aging treatments and final cold-working were performed in this order. A finished plate with a thickness in accordance with a final cold-working ratio was produced.

Comparatives Examples 1 to 12

The copper alloy materials corresponding to Comparative Examples were produced according to Table 1 and Table 2. Other general processes were the same as those in the production method of the Examples as described above. As described above, Table 1 shows the constituent elements of the copper alloy material.

TABLE 1

| | | Chemical composition (wt %) | | | | Ti/Ni |
|---|---|---|---|---|---|---|
| Example | | Cu | Ti | Ni | Impurities | ratio |
| Examples | 1 | Balance | 3.2 | 0.25 | — | 12.8 |
| | 2 | Balance | 3 | 0.25 | — | 15 |
| | 3 | Balance | 3.5 | 0.2 | — | 17.5 |
| | 4 | Balance | 3.2 | 0.25 | P0.01 | 12.8 |
| | 5 | Balance | 4 | 0.25 | — | 16 |
| | 6 | Balance | 2.5 | 0.2 | — | 12.5 |
| | 7 | Balance | 3.2 | 0.25 | Zn0.02 | 12.8 |
| | 8 | Balance | 3.8 | 0.35 | — | 10.8 |
| | 9 | Balance | 3.2 | 0.25 | — | 12.8 |
| | 10 | Balance | 3.2 | 0.25 | — | 12.8 |
| Comparative | 1 | Balance | 3.2 | — | — | to |
| Examples | 2 | Balance | 5 | 0.25 | — | 20 |
| | 3 | Balance | 1 | 0.25 | — | 4 |
| | 4 | Balance | 3.2 | 0.25 | — | 12.8 |
| | 5 | Balance | 3.2 | 0.25 | — | 12.8 |
| | 6 | Balance | 3.2 | 0.25 | — | 12.8 |
| | 7 | Balance | 3.2 | 0.5 | Co0.35, Cr0.5 | — |
| | 8 | Balance | 3.2 | 0.5 | Sn 0.35, Cr0.5 | — |
| | 9 | Balance | 3.2 | to | Fe 0.2 | — |
| | 10 | Balance | 3.2 | 0.25 | — | 12.8 |
| | 11 | Balance | 3.2 | 0.25 | P0.02 | 12.8 |
| | 12 | Balance | 3.2 | 0.25 | — | 12.8 |

As described above, Table 2 shows the production process conditions of the copper alloy material.

TABLE 2

| | | Process | | | | |
|---|---|---|---|---|---|---|
| Example | | Intermediate heat treating (° C. × Sec) | Solution treating (° C. × Sec) | First aging (° C. × Sec) | Second aging (° C. × Hour) | Final rolling (reduction ratio, %) |
| Examples | 1 | 700 × 1800 | 830 × 50 | 650 × 1800 | 400 × 5 | 10 |
| | 2 | 700 × 1800 | 830 × 50 | 650 × 1200 | 400 × 5 | 15 |
| | 3 | 700 × 3600 | 830 × 50 | 650 × 1200 | 400 × 5 | 10 |
| | 4 | 700 × 1200 | 830 × 50 | 650 × 1800 | 400 × 5 | 20 |
| | 5 | 700 × 1800 | 830 × 50 | 650 × 1800 | 400 × 5 | 10 |
| | 6 | 700 × 3600 | 830 × 50 | 650 × 1800 | 400 × 5 | 20 |
| | 7 | 700 × 1800 | 830 × 50 | 650 × 1800 | 400 × 5 | 15 |
| | 8 | 700 × 3600 | 830 × 50 | 650 × 1800 | 400 × 5 | 10 |
| | 9 | 650 × 1800 | 830 × 50 | 650 × 1800 | 400 × 5 | 15 |
| | 10 | 600 × 1800 | 830 × 50 | 650 × 1800 | 400 × 5 | 15 |
| Comparative | 1 | 700 × 1800 | 830 × 50 | 650 × 1800 | 400 × 5 | 10 |
| Examples | 2 | 700 × 1800 | 830 × 50 | 650 × 1800 | 400 × 5 | 10 |
| | 3 | 700 × 3600 | 830 × 50 | 650 × 1800 | 400 × 5 | 20 |
| | 4 | 850 × 1800 | 830 × 50 | 750 × 1800 | 400 × 5 | 15 |
| | 5 | 400 × 1800 | 830 × 50 | 450 × 1800 | 400 × 5 | 15 |
| | 6 | 700 × 1800 | 830 × 50 | 650 × 1800 | 400 × 5 | 75 |
| | 7 | Cracks during hot rolling | | | | |
| | 8 | | | | | |
| | 9 | 700 × 1800 | 830 × 50 | 650 × 1800 | 400 × 5 | 10 |
| | 10 | 700 × 1800 | 830 × 50 | 650 × 1800 | 300 × 5 | 15 |

TABLE 2-continued

| Example | Process | | | | |
|---|---|---|---|---|---|
| | Intermediate heat treating (° C. × Sec) | Solution treating (° C. × Sec) | First aging (° C. × Sec) | Second aging (° C. × Hour) | Final rolling (reduction ratio, %) |
| 11 | 700 × 1800 | 830 × 50 | 650 × 1800 | 550 × 5 | 15 |
| 12 | — | 830 × 50 | — | 400 × 5 | 15 |

The yield strength, electrical conductivity, bending workability, average grain size, fine precipitate size and areal density of each sample were evaluated by following methods.

TEST EXAMPLE (Yield Strength)

The yield strength was measured in the rolling direction in accordance with JIS Z 2241 using a tensile tester. The results are shown in Table 3.

(Electrical Conductivity)

The electrical resistance was measured with a 4-probe manner at 240 Hz and the percentage of the electrical conductivity ratio as a ratio between the resistance value of a pure copper as the standard reference sample and that of each sample was expressed by % IACS value. The results are shown in Table 3.

When cracks were not confirmed by the optical microscope, this was evaluated as O, whereas when cracks were confirmed, this was evaluated as X. The results are shown in Table 3.

(Average Grain Size)

After mechanical-polishing of a final specimen, a polished surface was measured using FE-SEM (manufactured by FEI, USA) at a magnification of 5,000 times and then a grain size appearing in a reflection electron image of 1000 $mm^2$ area was measured by using a grain measurement method via an intercept method (sectioning method, Heyn method). Then, the average grain size was determined. The results are shown in Table 3.

(Fine Precipitate Size and Areal Density)

Fine precipitates were observed at a magnification of 100,000 times or larger using a field emission transmission electron microscope (FE-TEM). Then, the size and areal density of the fine precipitates were calculated by replica analysis thereof. The results are shown in Table 3.

TABLE 3

| Example | | Mechanical property | | | Average | Fine precipitate | |
|---|---|---|---|---|---|---|---|
| | | Yield strength (MPa) | Electrical conductivity (% IACS) | Bending workability (180° R/t ≤ 1.5) | Grain size (μm) | Average size (nm) | areal density $10^8/cm^2$) |
| Examples | 1 | 920 | 16.8 | ○ | 2 | 119 | 4.4 |
| | 2 | 918 | 18 | ○ | 3.2 | 160 | 3.2 |
| | 3 | 956 | 15 | ○ | 2.5 | 127 | 4.8 |
| | 4 | 932 | 16 | ○ | 5 | 150 | 4.6 |
| | 5 | 963 | 18 | ○ | 1.8 | 195 | 5.4 |
| | 6 | 902 | 21 | ○ | 2 | 155 | 2.9 |
| | 7 | 915 | 16 | ○ | 3 | 152 | 3.0 |
| | 8 | 955 | 17.5 | ○ | 3.4 | 192 | 4.8 |
| | 9 | 924 | 16 | ○ | 2 | 165 | 4.0 |
| | 10 | 922 | 18 | ○ | 4.8 | 162 | 4.1 |
| Comparative Examples | 1 | 890 | 13 | ○ | 8.2 | 93 | 1.6 |
| | 2 | 970 | 9 | X | 3.8 | 315 | 2.4 |
| | 3 | 695 | 25 | ○ | 4.5 | 423 | 0.4 |
| | 4 | 880 | 15 | X | 3 | 550 | 2.4 |
| | 5 | 860 | 15 | X | 4.2 | 195 | 1.8 |
| | 6 | 945 | 10 | X | 7 | 252 | 3.4 |
| | 7 | Cracks during hot rolling | | | | | |
| | 8 | | | | | | |
| | 9 | 882 | 13 | X | 6.5 | 1389 | 2.4 |
| | 10 | 850 | 18 | X | 15 | 458 | 2.1 |
| | 11 | 830 | 21 | ○ | 8 | 152 | 5.4 |
| | 12 | 890 | 19 | X | 9 | 389 | 2.0 |

(Bending Workability)

R=bending radius of curvature and t=thickness of material are defined. A complete close bend test was performed in a direction perpendicular to the rolling direction (Good way direction) and in a direction parallel to the rolling direction (Bad way). The complete close bend test refers to a 180° U-shaped bend test). In this connection, R/t≤1.5 condition was applied.

Table 3 shows that the yield strength of specimens as produced according to Examples 1 to 10 is greater than or equal to 900 MPa, the electrical conductivity thereof was at least 15% IACS, and no crack occurs at 180° U shaped bending test under R/t≤1.5 in the rolling direction and the direction perpendicular to the rolling direction. After mechanical-polishing of a final specimen, a polished surface was measured using FE-SEM (manufactured by FEI, USA) at a magnification of 5,000 times and then a grain size appearing in a reflection electron image of 1000 $mm^2$ area was measured by using a grain measurement method via an intercept method (sectioning method, Heyn method). Thus, it was confirmed that the average grain size was 5 μm or smaller. Fine precipitates were observed at a magnification of 100,000 times or larger using a field emission transmission electron microscope (FE-TEM). Then, the size and areal density of the fine precipitates were calculated by replica analysis thereof. The fine precipitates at a size in a range of 300 nm or smaller are uniformly distributed in a copper matrix of the copper alloy material, wherein each of the fine precipitates includes at least one selected from a group consisting of (Cu,Ni)Ti, $(Cu,Ni_3)Ti_2$, $(Cu,Ni)_3Ti$, and $(Cu,Ni)_4Ti$. An areal density of the fine precipitates was greater than or equal to $2.5\times10^8/cm^2$. In accordance with the present disclosure, we found that after the double aging treatments, the characteristics of the material were changed according to the grain sizes, precipitate sizes and areal density distributions via analysis of the fine matrix thereof using the field emission type transmission electron microscope (FE-TEM).

Figure 2:
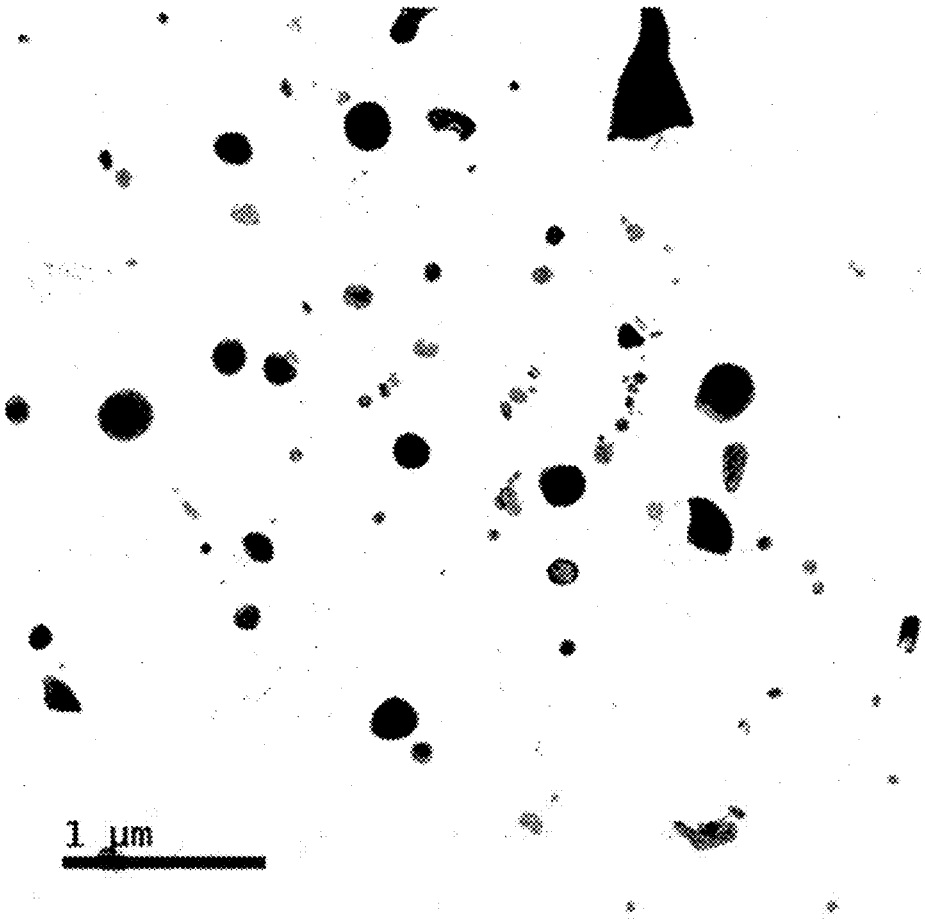
FIG. 2 shows photographs of sizes and areal densities of fine precipitates of (Cu,Ni)Ti, $(Cu,Ni_3)Ti_2$, $(Cu,Ni)_3Ti$, and $(Cu,Ni)_4Ti$, as replica analysis results of a field emission transmission electron microscope (FE-TEM) of a plate material sample made of a copper alloy material according to the present disclosure produced based on a composition (Cu-3.2Ti-0.25Ni) disclosed in a No. 1 of Table 1.
Figure 3:
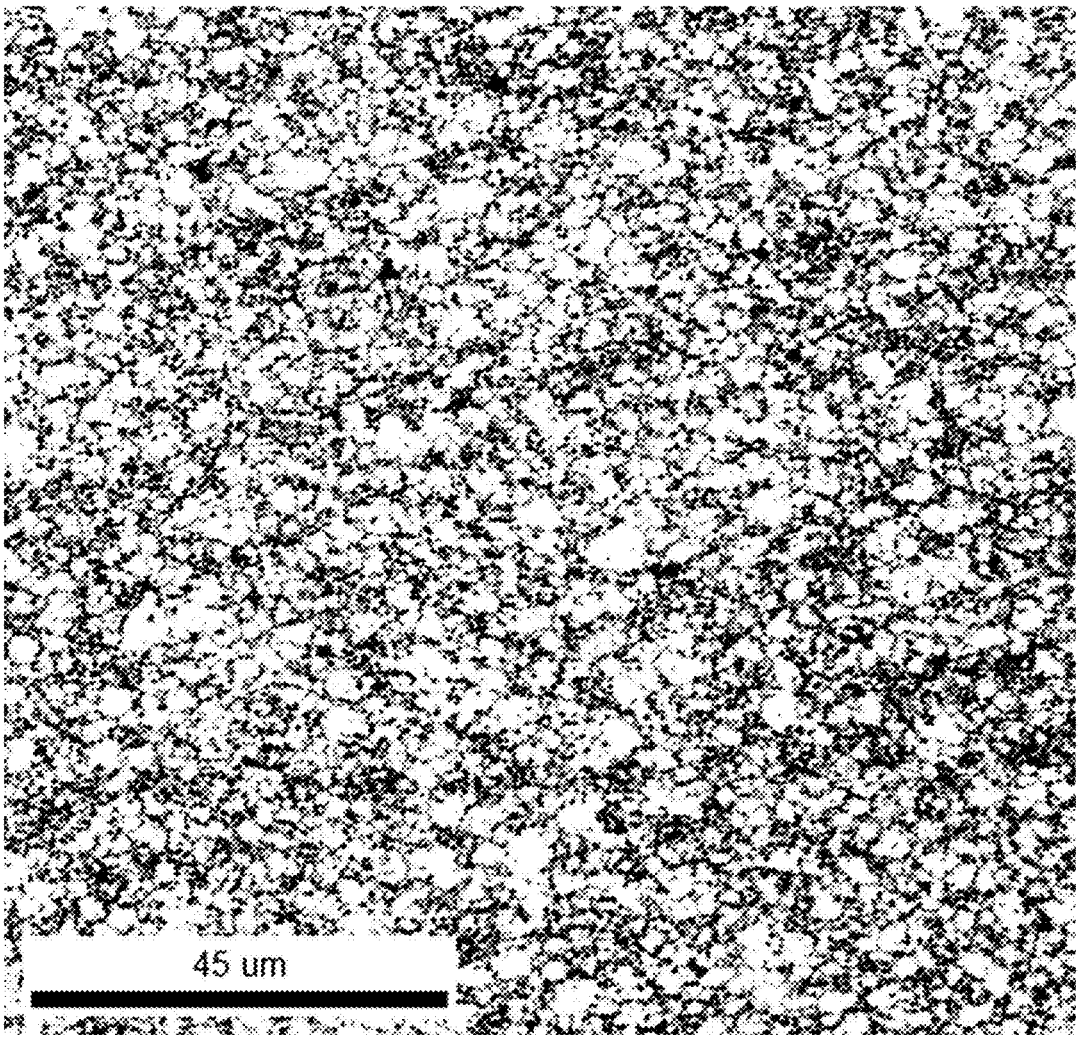
FIG. 3 shows a photograph of a fine structure resulting from EBSD (Electron Back Scatter Diffraction) analysis result of a field emission transmission electron microscope (FE-TEM) of a plate material sample made of a copper alloy material according to the present disclosure produced based on a composition (Cu-3.2Ti-0.25Ni) disclosed in a No. 1 of Table 1.

Specifically, we found that the grain sizes, fine precipitate sizes, and fine precipitate areal densities of the present material as subjected to the double aging treatment in Example 1 and the material as subjected to a single aging treatment as in Comparative Example 12 were significantly different from each other. In case of the material as not subjected to the double aging treatment as in Comparative Example 12, the grain size is 5 μm or larger, and the rolled matrix has developed, and the size of the copper, titanium-nickel ((Cu, Ni)—Ti)) precipitate became large, such that the yield strength and bending workability were adversely affected. As shown in FIG. 3, the grain size of the material as produced based on the range as presented in accordance with the present disclosure is very fine, that is, is smaller than 5 It was confirmed from the replica analysis after observing at a magnification of 100,000 times or greater using a field emission transmission electron microscope (FE-TEM) that, as shown in FIG. 1A, the fine precipitates at a size in a range of 300 nm or smaller are uniformly distributed in a copper matrix of the copper alloy material, wherein each of the fine precipitates includes at least one selected from a group consisting of (Cu,Ni)Ti, $(Cu,Ni_3)Ti_2$, $(Cu,Ni)_3Ti$, and $(Cu,Ni)_4Ti$. As shown in FIG. 2, an areal density of the fine precipitates is greater than or equal to $2.5\times10^8/cm^2$. The copper alloy material has a yield strength of at least 900 MPa, an electrical conductivity of at least 15% IACS, and a bending workability $R/t\leq1.5$ in both a rolling direction and a direction perpendicular to the rolling direction at a 180° bending test, wherein R indicates a bending radius of curvature and t indicates a thickness of the material.

In contrast, in Comparative Example 1, nickel (Ni) was not added. Thus, the bending workability was excellent, but the yield strength and electrical conductivity improvement by precipitate could not be expected. In Comparative Example 2, the titanium (Ti) content was 5 wt %, and cracking occurred in the bending workability test. In Comparative Example 3, the titanium (Ti) content was lower than 1.5 wt %, and thus, sufficient yield strength was not obtained. In Comparative Example 4, the first aging temperature is above 700° C., such that a large amount of precipitates was precipitated in the first aging. Then, in the second aging, the fine precipitates did not sufficiently precipitate and thus the yield strength was deteriorated and the bending crack occurred. In Comparative Example 5, the first aging temperature was lower than 550° C. and did not apply enough heat to form the second phase precipitate. As a result, both yield strength and bending workability were significantly reduced.

In Comparative Example 6, the final rolling ratio was larger than 70%, and the rolled matrix developed rapidly, failing to secure the bending workability. In Comparative Examples 7 and 8, the sum of impurities was larger than 0.8 weight % due to the addition of other elements such as Co and Sn, resulting in side cracks during the hot-working, failing to obtain the finished samples. In Comparative Example 9, copper, nickel-titanium ((Cu, Ni)—Ti) did not form a precipitate due to the alloy containing Fe, resulting in failing to secure sufficient yield strength and bending workability. However, the copper, nickel-titanium ((Cu, Ni)—Ti) did form a precipitate after the double aging treatment recited in the present disclosure. In Comparative Example 10, the second aging in the double aging treatment was performed at 350° C. or lower, such that copper, nickel-titanium ((Cu, Ni)—Ti) did not fully form the precipitates, resulting in reducing the yield strength and bending workability. In Comparative Example 11, in the double aging treatment, the second aging was performed at 500° C. or higher, such that the overaged region occurred and thus the bending workability was good but the yield strength was rapidly deteriorated.

According to the method for producing the copper alloy material in accordance with the present disclosure, the copper alloy material is prepared by adding nickel (Ni) to the copper-titanium (Cu—Ti) based on the Ti/Ni ratio to precipitate copper, nickel-titanium ((Cu, Ni)—Ti)) and by performing the solution treating and then the double aging treatments such that complex precipitates including not only the $Cu_3Ti$ phase with the poor coherence and the $Cu_4Ti$ phase with the good coherency against the α phase as a copper (Cu) matrix phase but also a CuTi phase, $Cu_3Ti_2$ phase, etc. are distributed very finely and uniformly. Thus, the grain size is smaller than 5 μm and thus very fine. The fine precipitates at a size in a range of 300 nm or smaller are uniformly distributed in a copper matrix of the copper alloy material wherein each of the fine precipitates includes at least one selected from a group consisting of (Cu,Ni)Ti, $(Cu,Ni_3)Ti_2$, $(Cu,Ni)_3Ti$, and $(Cu,Ni)_4Ti$. The areal density of the fine precipitates is greater than or equal to $2.5\times10^8/cm^2$. Thus, the present copper alloy material has a yield strength of at least 900 MPa, an electrical conductivity of at least 15% IACS, and a bending workability $R/t\leq1.5$ in both a rolling direction and a direction perpendicular to the rolling direction at a 180° bending test, wherein R indicates a bending radius of curvature and t indicates a thickness of the material. In this way, the copper alloy material according to the present disclosure is a material suitable for electrical and electronic parts such as connectors, which are evolving into lightweight, compact and high density products in the future.

What is claimed is:

1. A method for producing a copper alloy material for automobile and electric and electronic parts, wherein the copper alloy material contains 1.5 to 4.3 wt % of titanium (Ti), 0.05 to 1.0 wt % of nickel (Ni), 0.8 wt % or smaller of incidental impurities, and the balance being copper (Cu), wherein the incidental impurities are at least one element selected from a group consisting of Sn, Co, Fe, Mn, Cr, Zn, Si, Zr, V and P, and wherein a weight ratio of titanium/nickel (Ti/Ni) is in a range of $10<Ti/Ni<18$;

wherein the method comprises:

(a) dissolving and casting 1.5 to 4.3 wt % of titanium (Ti), 0.05 to 1.0 wt % of nickel (Ni), 0.8 wt % or smaller of incidental impurities, and the balance of copper (Cu) to obtain a slab;

(b) hot working the obtained slab at 750 to 1000° C. for 1 to 5 hours;

(c) first cold-working at a cold rolling reduction ratio or a cold working ratio of 50% or greater;

(d) intermediate heat treating at 550 to 740° C. for 5 to 10000 seconds;

(e) second cold-working at a cold rolling reduction ratio or a cold working ratio of 50% or greater;

(f) solution treating at 750 to 1000° C. for 1 to 300 seconds;

(g) first aging at 550 to 700° C. for 60 to 1800 seconds, continuously lowering a temperature, and then second aging at 350 to 500° C. for 1 to 20 hours;

(h) final cold-working at a cold rolling reduction ratio or a cold working ratio of 5 to 70%; and stress removal treating at 300 to 700° C. for 2 to 3000 seconds.

2. The method of claim 1, wherein each of the steps (e) and (f) is optionally repeated two to five times.

3. The method of claim 1, wherein the method further comprises correcting a shape of a plate after or before the (g) step.

4. The method of claim 1, wherein the method further comprises plating tin (Sn), silver (Ag), or nickel (Ni) on a plate after the (i) step.

5. The method of claim 1, wherein the method further comprises forming the slab into a plate, rod, or tube form.

6. The method of claim 1, wherein fine precipitates at a size in a range of 300 nm or smaller are uniformly distributed in a copper matrix of the copper alloy material, wherein each of the fine precipitates includes at least one selected from a group consisting of (Cu,Ni)Ti, $(Cu,Ni_3)Ti_2$, $(Cu,Ni)_3Ti$, and $(Cu,Ni)_4Ti$.

7. The method of claim 1, wherein an areal density of the fine precipitates is greater than or equal to $2.5\times10^8/cm^2$.

8. The method of claim 6, wherein the copper alloy material has a yield strength of at least 900 MPa, an electrical conductivity of at least 15% IACS, and a bending workability $R/t\leq1.5$ (180°) in both a rolling direction and a direction perpendicular to the rolling direction at a 180° bending test, wherein R indicates a bending radius of curvature and t indicates a thickness of the material.

* * * * *